US005224423A

United States Patent [19]

Borel

[11] Patent Number: 5,224,423

[45] Date of Patent: Jul. 6, 1993

[54] METHOD FOR MOUNTING AND FITTING A PRINTING PLATE ON A PLATE CYLINDER OF AN OFFSET PRINTING MACHINE

[75] Inventor: Edouard Borel, Corcelles-sur-Chavornay, Switzerland

[73] Assignee: Bobst S.A., Switzerland

[21] Appl. No.: 692,466

[22] Filed: Apr. 16, 1991

[30] Foreign Application Priority Data

Apr. 25, 1990 [CH] Switzerland ..... 01404/90

[51] Int. Cl.[5] ..... B41F 27/06

[52] U.S. Cl. ..... 101/415.1; 101/487; 29/895.212

[58] Field of Search ..... 101/375, 378, 415.1, 101/DIG. 36, 487, 488; 29/895.212

[56] References Cited

U.S. PATENT DOCUMENTS

| | | | |
|---|---|---|---|
| 2,664,821 | 1/1954 | Huffman | 101/378 |
| 2,990,000 | 6/1961 | Mangus et al. | 101/378 |
| 3,626,848 | 12/1971 | Tafel et al. | 101/415.1 |
| 3,757,691 | 9/1973 | Etchell et al. | 101/415.1 |
| 3,921,526 | 11/1975 | Gerny et al. | 101/378 |
| 4,089,265 | 5/1978 | White et al. | 101/375 |
| 4,191,106 | 3/1980 | Fermi et al. | 101/378 |
| 4,214,530 | 7/1980 | Signorelli et al. | 101/415.1 |
| 4,304,182 | 12/1981 | Etchell et al. | 101/415.1 |
| 4,648,318 | 3/1987 | Fischer | 101/378 |
| 4,930,205 | 6/1990 | Tasse | 29/895.212 |

FOREIGN PATENT DOCUMENTS

| | | | |
|---|---|---|---|
| 0246977 | 11/1987 | European Pat. Off. . | |
| 319378 | 3/1920 | Fed. Rep. of Germany . | |
| 1960635 | 6/1971 | Fed. Rep. of Germany . | |
| 57-18256 | 5/1982 | Japan . | |
| 57-107842 | 10/1982 | Japan . | |
| 73850 | 4/1985 | Japan | 101/415.1 |
| 1-76558 | 7/1989 | Japan | 101/415.1 |

*Primary Examiner*—Edgar S. Burr
*Assistant Examiner*—Stephen R. Funk
*Attorney, Agent, or Firm*—Hill, Steadman & Simpson

[57] ABSTRACT

For fitting an offset printing plate on a plate cylinder, both ends of the plate are provided with a bent end portion designed for being hooked onto a wall of a groove formed in the cylinder. The distance along the plate extending between two bending lines of the bent end portions is less than the distance, in the wrap-around direction of the plate on the cylinder, between the two walls of the groove. A first bent end portion is held into the groove, the plate is wrapped around the plate cylinder with a second end portion held proximate to the groove, the plate is subjected to thermal lengthening until the second end portion is aligned with, and can be inserted into, the groove. The end portions are strategically bent to cause a spring locking action when both are thusly inserted into the groove.

17 Claims, 3 Drawing Sheets

METHOD FOR MOUNTING AND FITTING A PRINTING PLATE ON A PLATE CYLINDER OF AN OFFSET PRINTING MACHINE

BACKGROUND OF THE INVENTION

The invention concerns the mounting and fitting of a printing plate on a plate cylinder of an offset printing machine.

The offset printing technique uses blocks having the shape of a thin metal plate, for instance of aluminum, on which the printing motif is engraved. This engraved plate called a block or a printing plate is fitted on the periphery of a rotary cylinder called a plate cylinder.

For this purpose, such a cylinder is generally provided with a peripheral groove of an appropriate radial depth and arranged parallel to the cylinder axis. The printing plate which may be wrapped all around the cylinder or else only around part of the cylinder has at both ends, with the plate viewed in a wrap-around direction, a bent part destined to be hooked into the cylinder peripheral groove.

Such a fitting method is described for instance in the U.S. Pat. No. No. 4,214,530 patent according to which each bent part has a allowing it to be adapted to, or firmly hooked onto, an edge of a radial wall of a groove cut into the peripheral surface of the cylinder. For arranging or mounting the printing plate, the reference teaches to initially hook the bent part of a first plate end onto the corresponding groove edge and then to wrap the plate around the cylinder in order to hook the other end in the proximity of the second groove edge with which the second part will then be engaged, the distance between the two bent parts being such that only force, i.e., tension, exerted on the plate will enable both bent parts to extend to and exceed the corresponding edge for being ultimately hooked thereon. Obviously, such a fitting system might have the shortcoming of a slight imprecision of distance occurring between the two bent parts of the plate. In cases where this distance is too short, such an error is likely to render the placing of the plate difficult on the cylinder because of excessive tension being required. In the event of an excessive distance, the plate may be retained onto the cylinder too loosely and such an arrangement may fail to keep the plate fixed on the cylinder during the printing process.

Another fitting method currently used consists in using printing plates having an oversize with regard to the peripheral cylinder dimension and having a connection of at least one of its ends to a cam-type locking system for tightening the plate in the rotary direction of the cylinder. Examples of such a design are described in the U.S. Pat. No. 3,626,848 and U.S. Pat. No. 3,757,691 patents. However, the incorporation of such a cam-type locking system into a cylinder groove like the one described herein would involve a difficult and expensive realization as well as the use of a rather broad groove with a resultant inking dead zone.

SUMMARY OF THE INVENTION

The objects of the present invention are to design a method for fitting printing plates without the shortcomings mentioned above, i.e., a process allowing:

1. easy and quick fitting of the printing plate to the cylinder;
2. a correct hold of the plate onto the cylinder in the course of operation;

3. minimum width of the dead zone resulting from the groove added to the cylinder for fitting the plate;
4. job changes with minimal costs;
5 the use of cylinder walls of minimum thickness for lesser weight.

A method is thus provided for mounting and fitting a printing plate or block onto a plate cylinder of a printing machine, the plate being subjected to thermal lengthening and subsequent contraction onto the plate cylinder while cooling down in the course of the mounting.

The invention is advantageously achieved in that the first end of the plate is bent along a first bending line to be initially hooked onto the two walls of a groove formed in the periphery of the cylinder, the plate to be wrapped around the cylinder in the direction of its rotation so as to approach the second end bent along a second bending line toward the groove, and the second end being hooked onto the corresponding wall of the groove. A first distance along the plate between the first and second bending lines is intentionally shorter than a second distance along the periphery of the cylinder between two edges on which the said two walls reach the cylinder periphery, and when the second end has been approached to immediate proximity with the groove, the whole plate is subjected to thermal lengthening arranged to make up for the difference of length between the first and second distances so that the second end can be extended to a position opposite the groove and then inserted into the groove and hooked onto the corresponding wall of the groove by means of a pushing device.

The two bent ends are advantageously fashioned to make up angles of about 96° and 90° respectively with the corresponding complimentary surface of the plate, and the groove is essentially made perpendicular to the peripheral surface of the cylinder. The second bent end is also extended by a small end strip portion further bent in the same direction to an angle of about 10°, this latter portion having been designed for allowing an easier penetration of the second end into the groove, and for bringing about a locking action after insertion.

During the thermal lengthening, the second end can be held by at least a single thread or wire or similar device so as to exert on the second end slight forces keeping it in contact with the peripheral surface of the cylinder.

The peripheral groove is advantageously fashioned with a width being slightly larger than twice the thickness of the plate.

The thermal lengthening of the plate can be carried out advantageously by a means for producing thermal waves.

Because the thermal lengthening tends to distort a motif engraved on the plate, the motif can undergo a previous deformation in an opposite direction to the thermal lengthening to compensate for the inevitable thermal lengthening distortion.

The plate can be provided with notches enabling a lateral pre-centering in the initial mounting phase and also with slots which in the final mounting phase allow accurate lateral centering of the two ends, the slots engaging with a pin situated in the center of the groove.

The advantageous method of the invention can be carried into practice by an apparatus including:

1. an emitter, emitting thermal waves, into which the cylinder can be inserted at least partially when the plate is being mounted thereon;

2. a movable gripper shiftable between a first position in which it is set off from the cylinder, and a second position in which it is able to hold the first end of the plate within the groove;
3. a pushing device shiftable between a first position in which it is set off from the cylinder, and a second position in which it is able to push the second end of the plate into the groove; and
4. a wire conforming along a portion of a wrapped around circumference of the plate so as to exert on the second end forces keeping the second end in contact with the peripheral surface of the cylinder.

DETAILED DESCRIPTION OF THE PREFERRED EMBODIMENTS

Figure 1:
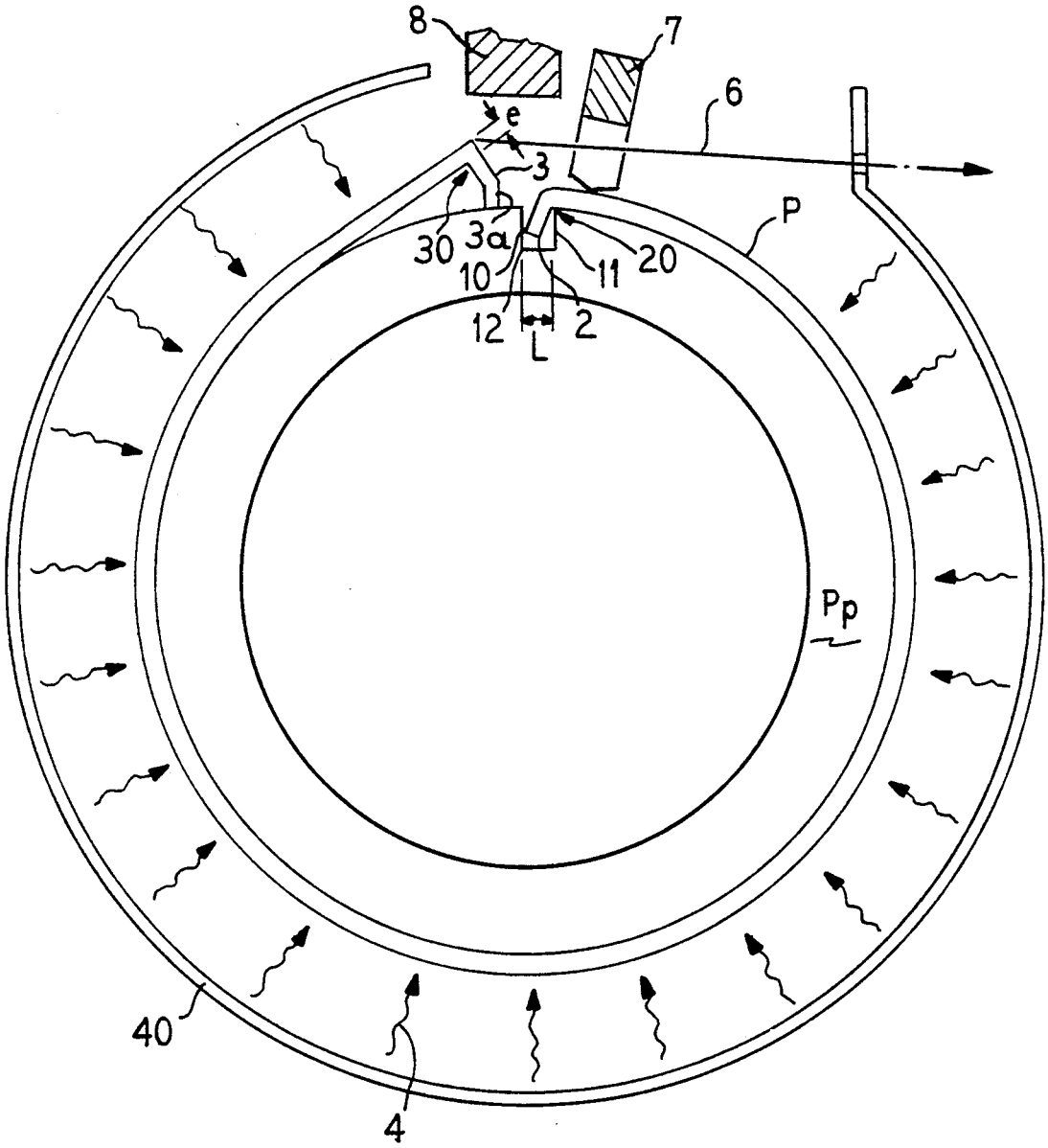
FIG. 1 is a simplified sectional view of a plate cylinder on which a printing plate is shown in the course of mounting.

FIG. 1 shows a simplified representation of a plate cylinder Pp, i.e., the cylindrical envelope around which will be wrapped a printing plate P in a direction in which the cylinder rotates when printing. It is understood that in reality, the cylinder Pp is mounted on a central shaft (not represented) rotated by one of its ends. A periphery of the cylinder Pp is provided with a groove 10 for receiving both ends 2, 3 of the plate P. The groove 10, of rectangular cross section, is arranged essentially perpendicularly on the surface of the cylinder Pp in radial position, its width being slightly larger than twice a thickness of the plate P. At a first end, the plate P comprises a first bent end portion 2 bent along a bending line 20 with a length slightly less that a radial depth of the groove 10. The first bent end portion 2 forms an angle of more than 90° with the complementary surface of the plate P, thus ensuring temporary hooking-on when the plate is wrapped around.

A second bent end portion 3 of the plate P is bent to 90° along a bending line 30; however, for functional improvement, this second bent end portion 3 includes at its distal end an additional short portion 3*a* bent in the same direction and through about 10° with regard to the second bent end portion 3. The total length of the second bent end portion 3 with the short portion 3*a* is, moreover, slightly less than the radial depth of the groove 10.

The mounting of the plate P on the cylinder Pp is partially similar to the one generally used and which consists in having both bent end portions 2, 3 engaged in the groove 10, or hooked on to one corresponding radial wall 11, 12 of the groove 10.

The present mounting and fitting method is different by the fact that the distance which separates the two bending lines 20, 30 along the plate P is less than a length extending along the periphery of the cylinder Pp between both edges with which the two radial walls 11, 12 of the groove 10 terminate at the periphery of the cylinder Pp. According to the invention, when the first bent end portion 2 has been engaged onto the corresponding wall 11 with the short portion 3*a* of the plate P wrapped around the cylinder Pp and approaches the other corresponding wall 12 of the groove 10, the whole plate P is subjected to thermal lengthening due to thermal waves 4 directed by a concentric thermal waves emitter 40 onto the cylinder Pp.

The thermal waves emitter 40 could be an infrared emitter. Tests have shown that the desired lengthening of the plate P can be obtained within a few seconds with adequate heating power and a heat level of less than 150° C.

Figure 2:
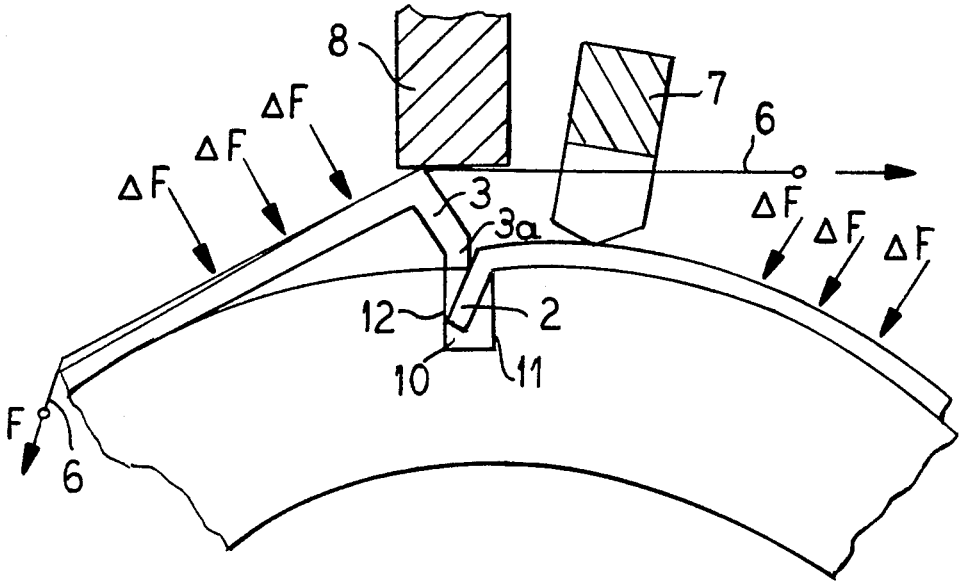
FIGS. 2 and 3 are partial sectional views of FIG. 1 representing the printing plate in the course of mounting.

FIG. 2 shows that when the plate P undergoes a thermal lengthening, its first bent end portion 2 is held in place within the groove 10 by a gripper 7 whereas the second bent end portion 3 is held by at least one wire 6 applying the forces $\Delta$ F in order to keep the second bent end portion 3 in contact with the peripheral surface of the cylinder Pp until interfitting with the first bent end portion 2 in the groove 10. As the short portion 3*a* is situated, at this stage, above the groove 10, the second bent end portion 3 needs only to be pushed into the groove 10 by means of a pusher 8.

When the plate P subsequently cools down, it will remain firmly and reliably tightened on the cylinder Pp. If L is equal to the width of the groove and e is equal to the thickness of the plate P, it has proved appropriate to determine $L=2e+$a small clearance, so as to minimize the width of the dead zone, while still enabling an easy fitting of the two ends 2, 3 within the groove 10. In this way, the width L of the groove 10 could be reduced to 0.85 mm with a depth of 6 mm. As the bent end portions 2, 3 (including 3*a*) will be flattened together when fully inserted, an adequate locking effect will thus be obtained.

Figure 3:
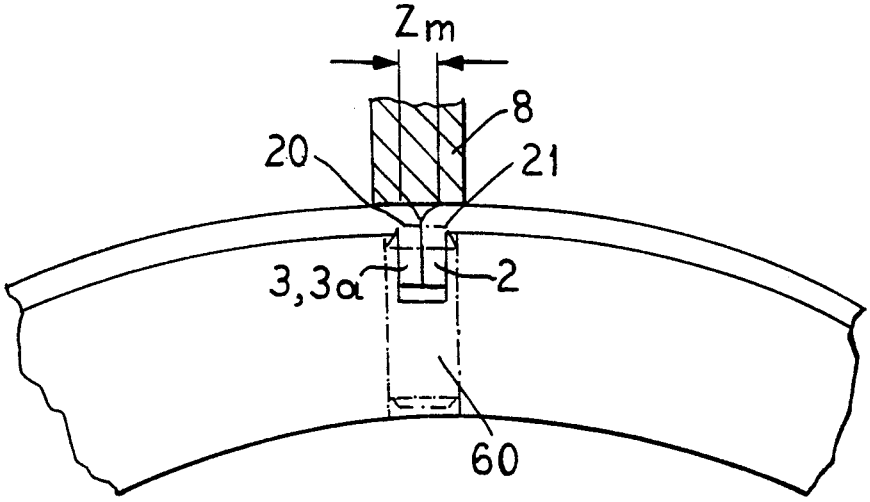

FIG. 3 shows the advantages of the fitting method described, in that:

1. the pusher 8 is pressed against the cylinder Pp in such a way that the peripheral ends 20, 21 of the plate are formed close to optimal curvation.
2. the inking dead zone Zm is minimal, i.e., close to double thickness of the plate. This is an intrinsically important feature to limit the radial excitation of the inking rollers when passing. In fact, an inking roller with a diameter of 110 mm would decrease by about 1.5 microns with each contact; the inking quality is thus influenced as little as possible.
3. another, invisible, advantage is that the service life of the photosensitive layers on the plates carrying the motif to be printed is increased by the heat applied; therefore, ovens are used already in practice to increase service life of plates, for example from 250,000 to 1,000,000 revolutions. Thus, the application of heat for mounting involves the secondary effect of positively increasing the service life of the printing plate.

From the above-description, the fact follows that the plate P once it is positioned on the cylinder Pp has, in a direction of the above-mentioned cylinder rotation, a greater length than when it is in a free state, i.e., before mounting on the cylinder Pp. The lengthening of the plate P thus entails a deformation of the motif initially engraved into the plate. In cases where such a deformation cannot be neglected, the recent developments in manufacturing printing plates by the use of digital image processing allow to envisage and to purposely cause anticipatory deformation of the motif in order to compensate the deformation due to thermal lengthening.

The invention also allows the removal of the thus mounted plate without damaging it by heat application and the use of a bar with heat-resistant suction cups (not represented) allowing the second bent end portion 3 of the plate to be pulled out. In this way, it is possible to mount and remove the same plate several times, if necessary.

Secondary, useful features are the high thermal inertia of the cylinder Pp and the very low thermal inertia of the plate P.

Figure 4:
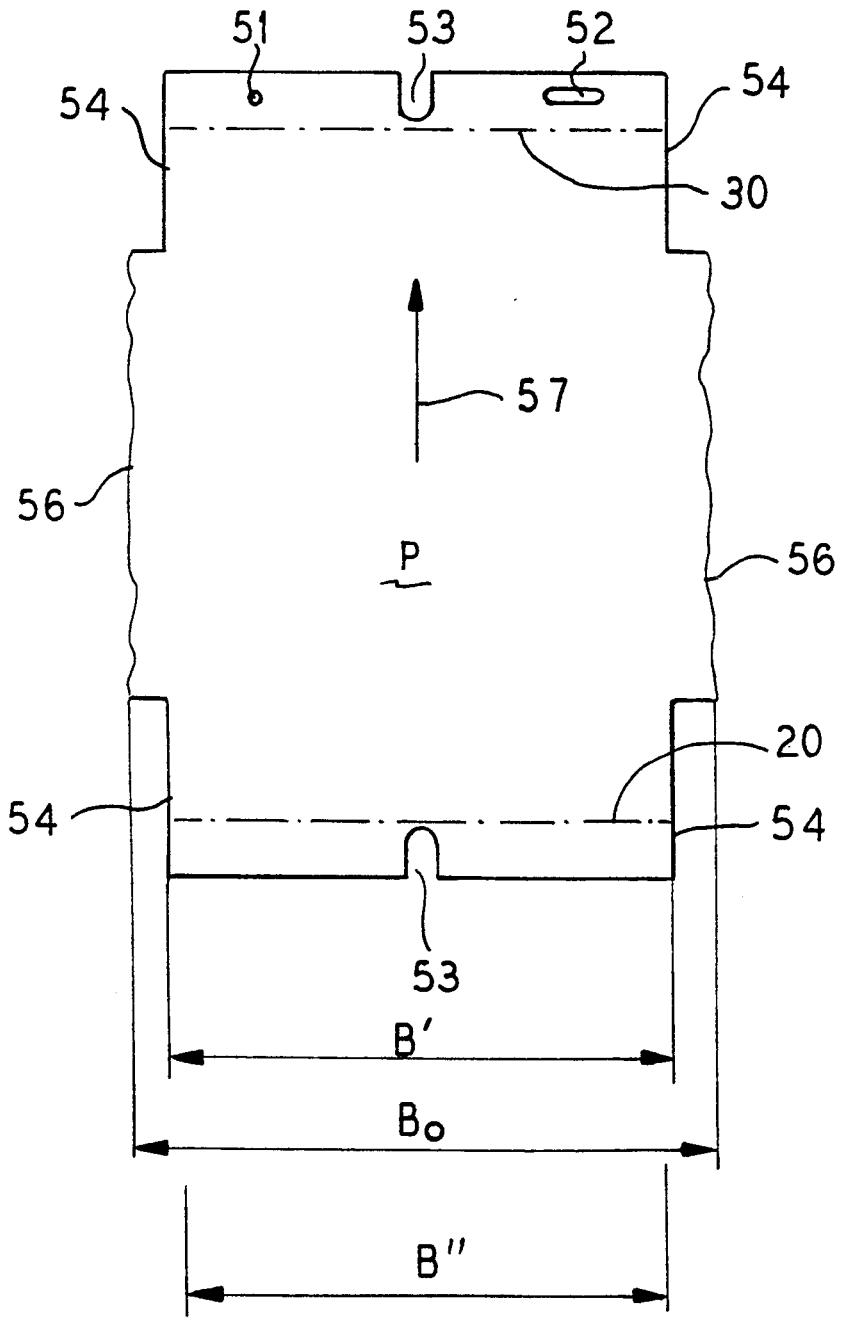
FIG. 4 is a partial plan view of a plate in a flat condition.

FIG. 4 shows a flat plate P, the lines 56 representing a full size blank width $B_O$, and punched calibrations or recesses 54 representing a useful width B' slightly larger than a maximum web width B".

The recesses, slots and apertures 51 to 54 are punched simultaneously. The recesses 54 enable lateral precentering in the state represented by FIG. 2 whereupon a first slot situated at the bent end portion 3 though not yet engaged allows final centering on a pin 60 (FIG. 3) to be inserted into the center of the groove 10.

The apertures 51, 52 and possibly a second slot 53 opposite the first slot 53 will contribute to centering the film and plate in the course of the exposure.

The travelling direction is indicated by arrow 57 and the bending lines by 20, 30.

Although the present invention has been described with reference to a specific embodiment, those of skill in the art will recognize that changes may be made thereto without departing from the scope and spirit of the invention as set forth in the appended claims.

I claim as my invention:

1. A method for mounting and fitting a printing plate or block on a plate cylinder of a printing machine, wherein the printing plate has opposite free ends, comprising the steps of:

providing a first and second edge on a surface of the plate cylinder;

hooking the plate at a first end portion adjacent one said free end of the plate to the first edge;

subjecting the plate to thermal lengthening;

wrapping the plate at least partially around the plate cylinder;

hooking the plate at a second end portion adjacent a respective opposite free end of the plate to the second edge;

and thereafter allowing the plate to cool down; and before thermal lengthening causing a pre-set contracted distortion in a motif engraved on said plate, distorted in a direction around a circumference of the plate cylinder, distorted contrary to the effect of said thermal lengthening.

2. A method according to claim 1, wherein the step of attaching the first and second free ends comprises the steps of:

providing a groove formed into a periphery of the plate cylinder, said groove having a first wall and a second wall which form said first edge and second edge respectively;

bending off said first end portion of the plate along a first bending line to be hookable onto said first ball of said groove;

bending off said second end portion along a second bending line;

fashioning the plate so that a first distance between the first and second bending lines is intentionally shorter than a second distance along the periphery of the plate cylinder between the first wall and the second wall of said groove, where said first and second walls reach the cylinder periphery;

with said second end portion held proximately to said groove, said thermal lengthening sufficient to make up the difference of length between said first distance and said second distance so that said second end portion can be aligned in a position above said groove; and exerting a pushing force onto said second end portion to hook said second end onto said second wall of said groove.

3. A method according to claim 2, wherein one of said first end portion and said second end portion is bent at an angle to interfere with a respective other of said first end portion and said second end portion as said first end portion and said second end portion are inserted into said groove, sand one of said first end portion and said second end portion flexing to cause a resilient locking action to hold said first end portion and said second end portion into said groove.

4. A method according to claims 2 or 3, comprising the step of holding said second end portion against said plate cylinder to keep said second end portion in contact with said plate cylinder during thermal lengthening.

5. A method according to claims 2 or 3, wherein said thermal lengthening of said plate is accomplished by thermal waves.

6. A method according to claim 1, wherein the plate is wrapped completely around the plate cylinder.

7. A method according to claim 1, wherein the third listed step, thermal lengthening, occurs after the second listed step, hooking the plate at the first end portion.

8. A method according to claim 1, wherein the third listed step, thermal lengthening, occurs after the fourth listed step, wrapping the plate.

9. A method according to claim 1, wherein said thermal lengthening of said plate is accomplished by thermal waves.

10. An apparatus for mounting a printing plate onto a plate cylinder of a printing machine, comprising:

a plate cylinder having a radial groove formed in a periphery of said plate cylinder and extending along an axial length of said plate cylinder, said groove having a first wall and a second wall;

a printing plate having a first bent end portion and a second bent end portion on opposite ends of said printing plate, said first and second bent end portions bent off from said printing plate along a first and second bending line respectively;

said printing plate sized in length such that a first distance between said first and second bending lines is shorter by a discrete distance in a free state than a second distance around said plate cylinder periphery between said first wall and said second wall, said first and second distances considered with said plate and said cylinder at equal temperature;

said printing plate fashioned of a material such that said first distance can be lengthened by heating at least by as much as said discrete distance;

means for heating said plate to lengthen by at least said discrete distance;

said printing plate thermally lengthened and said first bent end portion and said second bent end portion inserted and held into said groove by said first and second walls with said printing plate wrapped around said plate cylinder stretched under tension after cool down to equal temperature with said cylinder; and wherein said fist bent end portion is bent in a first rotational direction to an angle of about 96° with a corresponding contiguous surface of the plate; and said second bent end portion is bent in a second rotational direction to make up an angle of about 90° respectively between a base portion of said second bent end portion and a corresponding contiguous surface of the plate;

wherein said groove is essentially made perpendicular to said periphery of the plate cylinder; and said second bent end portion provides a short distal end portion bent off further in said second rotational direction to an angle of about 10° from said base portion.

11. An apparatus according to claim 10, wherein a width of said groove is arranged to be equal to twice a thickness of the plate at said bent end portions plus a small clearance allowing fitting of said bent end portions thereinto.

12. An apparatus according to claim 10, wherein said plate is provided with a plurality of notches enabling a lateral pre-centering in an initial mounting phase;

said plate cylinder provides a centering pin arranged centered in said groove; and said plate is provided with slots which allow accurate lateral centering of said first and second bent end portions, said slots engaging over said pin.

13. An apparatus according to claim 10, further comprising:

means for holding said first bend end portion into said groove;

means for holding said second bent end portion, with said plate wrapped around said plate cylinder, against said periphery of said plate cylinder; and means for pushing said second bent end portion into said groove.

14. An apparatus for mounting a printing plate onto a plate cylinder of a printing machine, comprising:

a plate cylinder having a radial groove formed in a periphery of said plate cylinder and extending along an axial length of said plate cylinder, said groove having a first wall and a second wall;

a printing plate having a first bent end portion and a second bent end portion on opposite ends of said printing plate, said first and second bent end portions bent off from said printing plate along a first and second bending line respectively;

said printing plate sized in length such that a first distance between said first and second bending lines is shorter by a discrete distance in a free state than a second distance around said plate cylinder periphery between said first wall and said second wall, said first and second distances considered with said plate and said cylinder at equal temperature;

said printing plate fashioned of a material such that said first distance can be lengthened by heating at least by as much as said discrete distance;

means for heating said plate to lengthen by at least said discrete distance;

said means for heating comprises an emitter, emitting thermal waves and having a structure into which said plate cylinder can be inserted at least partially while said plate is being mounted;

said printing plate thermally lengthened and said first bent end portion and said second bent end portion inserted and held into said groove by said first and second walls with said printing plate wrapped around said plate cylinder stretched under tension after cool down to equal temperature with said cylinder; and a movable gripper shiftable between a first position in which said movable gripper is set off from said cylinder, and a second position in which it is able to hold said first bent end portion of said plate within said groove; and said pushing device shiftable between a first position in which it is set off from said cylinder, and a second position in which it is able to push said second bent end portion of said plate within said groove.

15. An apparatus for mounting a printing plate onto a plate cylinder of a printing machine, comprising:

a plate cylinder having a radial groove formed in a periphery of said plate cylinder and extending along an axial length of said plate cylinder, said groove having a first wall and a second wall;

a printing plate having a first bent end portion and a second bent end portion on opposite ends of said printing plate, said first and second bent end portions bent off from said printing plate along a first and second bending line respectively;

said printing plate sized in length such that a first distance between said first and second bending lines is shorter by a discrete distance in a free state than a second distance around said plate cylinder periphery between said first wall and said second wall, said first and second distances considered with said plate and said cylinder at equal temperature;

said printing plate fashioned of a material such that said first distance can be lengthened by heating at least by as much as said discrete distance;

means for heating said plate to lengthen by at least said discrete distance;

said printing plate thermally lengthened and said first bent end portion and said second bent end portion inserted and held into said groove by said first and second walls with said printing plate wrapped around said plate cylinder stretched under tension after cool down to equal temperature with said cylinder; and a holding wire, said holding wire wrappable around a portion of said plate while said plate is wrapped around said plate cylinder, and means for tensioning said wire to exert a force onto said second bent end portion, holding said second bent end portion to said periphery of said plate cylinder during thermal lengthening.

16. A method for mounting and fitting a printing plate or block on a plate cylinder of a printing machine, wherein the printing plate is planar having opposite free ends comprising the steps of:

providing a groove formed into a periphery of the plate cylinder, said groove having a first wall and a second wall;

bending a first end portion adjacent one free end of the plate along a first bending line to be hookable onto said first wall of said groove;

hooking said first end portion to said first wall of said groove;

wrapping the plate around the plate cylinder in a direction about an axis of rotation of the plate cylinder;

bending a second end portion adjacent a respective other free end of the plate along a second bending line;

fashioning the plate so that a first distance between the first and second bending lines is intentionally shorter than a second distance along the periphery of the plate cylinder between the first wall and the second wall of said groove, where said first and second walls reach the cylinder periphery;

with said second end portion held proximate to said groove, subjecting said plate to thermal lengthening sufficient to make up the difference of length between said first distance and said second distance so that said second end portion can be aligned in a position above said groove; and exerting a pushing force onto said second end portion to hook said second end onto said second wall of said groove;

allowing the plate to thereafter cool down; and before thermal lengthening, causing a pre-set contracted distortion in a motif engraved on said plate, distorted in a direction around a circumference of the plate cylinder, distorted contrary to the effect of said thermal lengthening.

17. Method for mounting and fitting a printing plate or block on a plate cylinder of a printing machine, wherein the printing plate is planar having opposite free ends, comprising the steps of:

providing a groove formed into a periphery of the plate cylinder, said groove having a first wall and a second wall;

bending a first end portion adjacent one free end of the plate along a first bending line to be hookable onto said first wall of said groove;

hooking said first end portion to said first wall of said groove;

wrapping the plate around the plate cylinder in a direction about an axis of rotation of the plate cylinder;

bending a second end portion adjacent a respective other free end of the plate along a second bending line;

fashioning the plate so that a first distance between the first and second bending lines is intentionally shorter than a second distance along the periphery of the plate cylinder between the first wall and the second wall of said groove, where said first and second walls reach the cylinder periphery;

with said second end portion held proximate to said groove, subjecting said plate to thermal lengthening sufficient to make up the difference of length between said first distance and said second distance so that said second end portion can be aligned in a position above said groove; and exerting a pushing force onto said second end portion to hook said second end onto said second wall of said groove;

allowing the plate to thereafter cool down wherein one of said first end portion and said second end portion is bent at an angle to interfere with a respective other of said first end portion and said second end portion as said first end portion and said second end portion are inserted into said groove, and one of said first end portion and said second end portion flexing to cause a resilient locking action to hold said first end portion and said second end portion into said groove; and before thermal lengthening, causing a pre-set contracted distortion in a motif engraved on said plate, distorted in a direction around a circumference of the plate cylinder, distorted contrary to the effect of said thermal lengthening.

* * * * *